US009279626B2

(12) United States Patent
Berukhim et al.

(10) Patent No.: US 9,279,626 B2
(45) Date of Patent: Mar. 8, 2016

(54) PLATE-FIN HEAT EXCHANGER WITH A POROUS BLOCKER BAR

(75) Inventors: David Berukhim, Los Angeles, CA (US); Andrew Leishman, Long Beach, CA (US); Vahe Avanessian, Pacific Palisades, CA (US)

(73) Assignee: Honeywell International Inc., Morris Plains, NJ (US)

( * ) Notice: Subject to any disclaimer, the term of this patent is extended or adjusted under 35 U.S.C. 154(b) by 1082 days.

(21) Appl. No.: 13/356,525

(22) Filed: Jan. 23, 2012

(65) Prior Publication Data

US 2013/0191079 A1 Jul. 25, 2013

(51) Int. Cl.

| | |
|---|---|
| ***F28F 7/00*** | (2006.01) |
| ***F28F 13/00*** | (2006.01) |
| ***F28F 9/02*** | (2006.01) |
| ***F28D 9/00*** | (2006.01) |

(52) U.S. Cl.

CPC ..... *F28F 13/003* (2013.01); *F28D 9/0062* (2013.01); *F28F 9/028* (2013.01)

(58) Field of Classification Search

CPC ..... F28F 13/003; F28F 13/02; F28F 13/18; F28F 13/04; F28F 13/12; F28F 13/06; F28F 13/08

See application file for complete search history.

(56) References Cited

U.S. PATENT DOCUMENTS

| | | | | | |
|---|---|---|---|---|---|
| 2,401,797 | A | * | 6/1946 | Rasmussen | F28F 13/003 165/164 |
| 3,262,190 | A | * | 7/1966 | Rostoker et al. | B21D 53/04 165/180 |
| 3,272,260 | A | * | 9/1966 | Raub | F28F 7/02 165/164 |
| 3,302,704 | A | * | 2/1967 | Valyi | B22F 7/002 165/170 |
| 3,306,353 | A | * | 2/1967 | Burne | F28F 1/02 165/164 |
| 3,490,718 | A | * | 1/1970 | Vary | B64G 1/50 165/104.25 |
| 3,502,141 | A | * | 3/1970 | Allen | F28F 13/06 159/28.1 |
| 3,559,722 | A | * | 2/1971 | Schauls | F25J 5/002 159/16.1 |
| 3,587,730 | A | * | 6/1971 | Milton | F25J 5/005 159/DIG. 28 |

(Continued)

OTHER PUBLICATIONS

Jian Yang et al., Forced Convection Heat Transfer Enhancement by Porous Pin Fins in Rectangular Channels, , , Abstract.

(Continued)

*Primary Examiner* — Ljiljana Ciric
(74) *Attorney, Agent, or Firm* — Shimokaji IP

(57) ABSTRACT

The plate-fin heat exchanger includes a first fluid pathway running along a first axis, a second fluid pathway running along a second axis perpendicular to the first axis, and a blocker bar having an inlet face and an outlet face. The blocker bar inlet face coincides with a heat exchanger face. The blocker bar is at an inlet of the second fluid pathway and receives a second fluid. The outlet face of the blocker bar is at the inlet of the second fluid pathway. The blocker bar includes a set of spaced apart pores that extend from the inlet face to the outlet face.

11 Claims, 5 Drawing Sheets

(56) References Cited

U.S. PATENT DOCUMENTS 3,590,914 A * 7/1971 Duncan ..... F28D 9/0068 165/166
3,595,310 A * 7/1971 Burne ..... F28F 13/003 165/159
3,598,180 A * 8/1971 Moore, Jr. ..... F28D 15/046 165/104.26
3,607,369 A * 9/1971 Batta ..... A61C 8/00 106/1.12
3,613,778 A * 10/1971 Feldman, Jr. ..... B64G 1/506 165/104.26
3,732,919 A * 5/1973 Wilson ..... F16L 9/00 165/110
3,776,303 A * 12/1973 Anderson ..... F28D 7/12 165/158
3,905,203 A * 9/1975 Jacob ..... F24F 3/1405 165/110
3,934,117 A * 1/1976 Schladitz ..... F24H 1/105 338/205
3,982,981 A * 9/1976 Takao ..... B01D 46/00 156/205
3,983,191 A * 9/1976 Schauls ..... F25J 5/002 165/166
4,051,898 A * 10/1977 Yoshino ..... B60H 1/00328 165/166
4,060,125 A * 11/1977 Fujie ..... F28F 13/187 165/133
4,222,434 A * 9/1980 Clyde ..... B01J 15/005 138/38
4,274,479 A * 6/1981 Eastman ..... F28D 15/046 122/366
4,285,385 A * 8/1981 Hayashi ..... B22D 18/04 164/112
4,393,924 A * 7/1983 Asami ..... F28D 20/003 165/104.12
4,449,992 A * 5/1984 Yamada ..... F28D 21/0015 96/7
4,460,388 A * 7/1984 Fukami ..... F24F 13/30 165/166
4,616,695 A * 10/1986 Takahashi ..... F28D 9/0068 165/166
4,694,378 A * 9/1987 Nakayama ..... H01L 23/427 165/80.4
4,699,209 A * 10/1987 Thorogood ..... 165/110
4,715,431 A * 12/1987 Schwarz ..... F28D 9/0081 165/110
4,715,433 A * 12/1987 Schwarz et al. ..... 165/166
4,729,428 A * 3/1988 Yasutake ..... F28D 9/0062 165/153
4,823,863 A * 4/1989 Nakajima ..... H01L 23/3733 165/80.4
4,898,234 A * 2/1990 McGovern ..... F28D 1/0366 126/669
5,123,982 A * 6/1992 Kuzay ..... F28F 13/003 156/89.28
5,125,451 A * 6/1992 Matthews ..... F28F 3/12 165/167
5,205,353 A * 4/1993 Willemsen ..... F28F 13/003 165/170
5,229,078 A * 7/1993 Haerle ..... B01D 25/26 422/171
5,266,279 A * 11/1993 Haerle ..... B01D 39/12 422/177
RE34,651 E * 6/1994 Hoopman ..... C25D 1/02 205/67
5,318,114 A * 6/1994 Sasaki ..... F28D 1/035 165/109.1
5,381,859 A * 1/1995 Minakami ..... F28F 3/02 165/185
5,437,328 A * 8/1995 Simons ..... F28F 3/086 165/146
5,441,716 A * 8/1995 Rockenfeller ..... 423/299
5,564,496 A * 10/1996 Blum ..... F28D 9/0062 165/133
5,727,622 A * 3/1998 Gurevich ..... F28F 13/003 165/122
5,823,249 A * 10/1998 Batchelder ..... F28D 9/0025 165/121
5,847,927 A * 12/1998 Minning ..... F28F 13/003 165/80.3
5,884,691 A * 3/1999 Batchelder ..... F28F 3/022 165/185
5,957,194 A * 9/1999 Azar ..... F28F 3/02 165/185
5,960,861 A * 10/1999 Price ..... F28F 13/003 165/165
6,019,170 A * 2/2000 Yokoya ..... F28D 9/0062 165/166
6,032,726 A * 3/2000 Wright ..... F28F 1/40 138/38
6,054,229 A * 4/2000 Hsu ..... F24F 5/00 165/48.1
6,102,109 A 8/2000 Osakabe et al.
6,142,222 A * 11/2000 Kang ..... F28F 13/003 165/148
6,378,605 B1 * 4/2002 Kutscher ..... F28B 1/06 165/181
6,399,149 B1 * 6/2002 Klett ..... B32B 5/18 427/230
6,411,508 B1 * 6/2002 Kang ..... H01L 23/3733 165/185
6,424,529 B2 * 7/2002 Eesley ..... 165/80.3
6,424,531 B1 * 7/2002 Bhatti ..... F28F 3/02 165/185
6,561,265 B2 * 5/2003 Ohira ..... F28D 7/0066 165/11.1
6,591,897 B1 * 7/2003 Bhatti ..... H01L 23/3677 165/185
6,983,788 B2 * 1/2006 Haglid ..... F24F 5/0035 165/165
6,986,382 B2 * 1/2006 Upadhya ..... F04B 19/006 165/104.21
6,988,535 B2 * 1/2006 Upadhya et al. ..... 165/104.33
7,013,956 B2 * 3/2006 Thayer ..... F25B 23/006 165/104.25
7,017,655 B2 * 3/2006 Wilson ..... F28D 15/0266 165/104.33
7,111,673 B2 * 9/2006 Hugill ..... B01D 3/14 165/147
7,124,812 B1 * 10/2006 Agee ..... F28D 9/0037 165/146
7,168,482 B2 * 1/2007 Lee ..... F24F 3/147 165/166
7,353,864 B2 4/2008 Zaffetti et al.
7,367,203 B2 5/2008 Katoh et al.
7,467,467 B2 * 12/2008 Prociw ..... B22F 7/004 29/890.03
7,549,460 B2 * 6/2009 East ..... F28F 3/022 165/104.33
7,604,779 B2 * 10/2009 Liu ..... B01D 53/8675 422/177
7,604,782 B1 * 10/2009 Dingell ..... F25B 19/00 23/294 R
7,780,944 B2 * 8/2010 Mathias ..... B01J 19/0093 423/650
7,836,597 B2 * 11/2010 Datta ..... F04B 17/00 165/104.33
7,966,841 B2 * 6/2011 Lowenstein ..... F24F 3/1417 62/271
7,997,098 B2 * 8/2011 Yabu ..... B01D 53/261 252/69
8,069,912 B2 * 12/2011 Campagna ..... B21D 53/02 165/157
8,129,036 B2 * 3/2012 Beringer ..... F28D 9/0062 165/905
8,162,042 B2 * 4/2012 Haglid ..... F24F 12/006 165/165
8,252,245 B2 * 8/2012 Tonkovich ..... B01B 1/005 165/104.19
8,322,406 B2 * 12/2012 Du et al. ..... 165/166
8,770,267 B2 * 7/2014 Nagashima ..... B22F 3/11 165/104.34
8,881,797 B2 * 11/2014 Melo ..... F28D 9/0062 165/166

(56) References Cited

U.S. PATENT DOCUMENTS 8,953,314 B1 * 2/2015 Fedorov ..... H01L 23/44 257/707
2001/0032720 A1 * 10/2001 Eesley ..... F28F 3/02 165/185
2001/0045270 A1 * 11/2001 Bhatti ..... F28F 3/02 165/80.3
2002/0003691 A1 * 1/2002 Eesley ..... F28F 3/02 361/703
2002/0056370 A1 * 5/2002 Masada ..... B01D 53/22 96/8
2002/0092643 A1 * 7/2002 Fawcett ..... F28F 13/003 165/104.16
2002/0108743 A1 * 8/2002 Wirtz ..... F28F 13/003 165/185
2004/0050538 A1 * 3/2004 Sunder ..... F25J 5/002 165/133
2004/0112585 A1 * 6/2004 Goodson ..... F04B 19/006 165/299
2004/0188066 A1 * 9/2004 Upadhya ..... F04B 17/00 165/80.4
2004/0200605 A1 * 10/2004 Yoshida ..... B01B 1/005 165/142
2005/0082037 A1 * 4/2005 Thayer ..... H01L 23/3733 165/80.4
2005/0089731 A1 * 4/2005 Ogiwara ..... C01B 3/34 429/413
2005/0211417 A1 * 9/2005 Upadhya ..... F04B 19/006 165/80.4
2005/0211418 A1 * 9/2005 Kenny ..... F04B 17/00 165/80.4
2005/0211427 A1 * 9/2005 Kenny ..... F28D 15/0266 165/299
2006/0090887 A1 * 5/2006 Kato ..... F28D 9/005 165/166
2007/0034356 A1 * 2/2007 Kenny ..... F04B 17/00 165/80.4
2007/0053168 A1 * 3/2007 Sayir ..... B32B 18/00 361/718
2007/0228113 A1 * 10/2007 Dupree ..... F28D 9/0081 228/183
2007/0235174 A1 * 10/2007 Dakhoul ..... F28D 9/0075 165/167
2007/0246191 A1 * 10/2007 Behrens ..... F28D 1/0366 165/80.4
2007/0247812 A1 * 10/2007 Behrens ..... F28F 3/12 361/699
2007/0284095 A1 * 12/2007 Wang ..... F28D 7/10 165/166
2008/0042306 A1 * 2/2008 Reinders ..... F24F 5/0035 261/153
2008/0044621 A1 * 2/2008 Strauss ..... B22F 3/1112 428/108
2008/0093059 A1 * 4/2008 Nishida ..... B01D 53/261 165/133
2008/0179046 A1 * 7/2008 Hisano ..... F28D 15/00 165/104.11
2008/0196869 A1 * 8/2008 Behrens ..... F28F 3/12 165/104.33
2008/0296008 A1 * 12/2008 Kim ..... F28D 1/0325 165/182
2009/0008066 A1 * 1/2009 Meng ..... F04D 29/582 165/104.33
2009/0071638 A1 * 3/2009 Murayama ..... F24F 3/147 165/166
2009/0101321 A1 * 4/2009 Ostersetzer ..... F28F 3/02 165/164
2009/0145581 A1 * 6/2009 Hoffman ..... F28F 1/40 165/80.3
2009/0211740 A1 * 8/2009 Kesseli ..... F28D 9/0043 165/166
2009/0308571 A1 * 12/2009 Thompson ..... F28F 13/003 165/79
2009/0320291 A1 * 12/2009 O'Neill ..... B23K 1/0012 29/890.046
2010/0038051 A1 * 2/2010 Behrens ..... B64C 1/40 165/41
2010/0263823 A1 * 10/2010 Mitsuhashi ..... F28D 9/0062 165/11.1
2011/0061848 A1 * 3/2011 Chiou ..... F28F 13/003 165/185
2012/0193083 A1 * 8/2012 Zaffetti ..... F28D 9/0062 165/185
2012/0285659 A1 * 11/2012 Sim ..... F28D 7/1684 165/96

OTHER PUBLICATIONS

S. Narasimhan et al., Flow and Pressure Field Characteristics in the Porous Block Compact Modeling of Parallel Plate Heat Sinks, , , Abstract.
S. Z. Shuja & B.S. Yilbas, Flow over Rectangular Porous Block in a Fixed Width Channel: Influence of Porosity and Aspect Ratio, , , Abstract.
Jainender Dewatvval, Design of Compact Plate Fin Heat Exchanger, , , 16.

* cited by examiner

PLATE-FIN HEAT EXCHANGER WITH A POROUS BLOCKER BAR

BACKGROUND AND SUMMARY OF THE INVENTION

The present invention generally relates to high-temperature plate-fin heat exchangers. Such heat exchangers may include a cold fluid pathway and a hot fluid pathway. The heat exchanger may be used to heat cold fluid (e.g., outside air) and/or cool hot fluid (e.g., cooling fluid from an engine). Plate-fin heat exchangers may operate with any combination of fluids (gas, liquid, or two-phase fluid). The hot fluid may include transient changes in temperature due to various operating conditions (e.g., increased heat from engine throttling).

Such transient changes in temperature create gradients throughout the heat exchanger that may cause degraded performance and/or operating life due to thermal fatigue of tube sheets with the heat exchanger. High-temperature heat exchangers may be especially susceptible to fatigue at the hot/hot corner (the corner at the hot inlet and cold outlet) and the hot/cold corner (the corner at the hot inlet and the cold inlet).

Accordingly, there is a need for a heat exchanger with improved resistance to thermal fatigue.

In one aspect of the present invention, a plate-fin heat exchanger adapted to reduce thermal fatigue, includes a cold fluid pathway running along a first axis, a hot fluid pathway running along a second axis perpendicular to the first axis, and at least one porous blocker bar running along the first axis, where the porous blocker bar includes a set of pores adapted to control flow along the hot fluid pathway and coupled to an inlet of the hot fluid pathway.

In another aspect of the present invention, a porous blocker bar adapted for use in a plate-fin heat exchanger includes a front face, a rear face, and multiple pores, each of the pores spanning from the front face to the rear face.

In yet another aspect of the present invention, a method of configuring a porous blocker bar for use in a plate-fin heat exchanger includes: receiving dimensional parameters, evaluating the received parameters, calculating design parameters at least partly based on the received parameters, and storing the calculated design parameters.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. Broadly, embodiments of the present invention generally provide a way to reduce fatigue experienced by components of a heat exchanger and improve temperature gradients within the heat exchanger. The porous blocker bars of the present invention may be configured such that structural integrity of the heat exchanger may be improved and hot flow may be reduced and/or dampened. In this manner, the operating life and performance of the heat exchanger may be improved.

Figure 1:
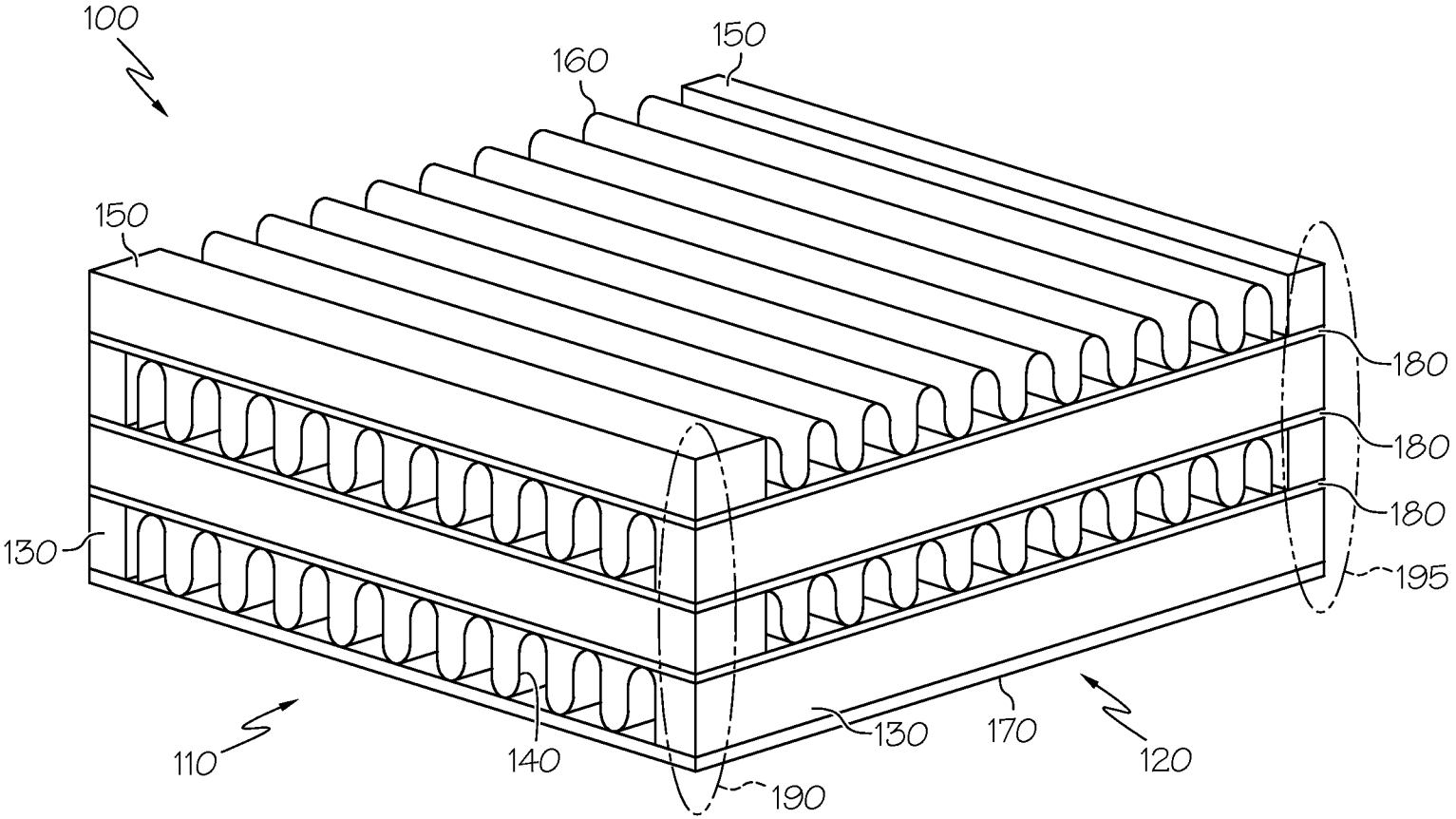
FIG. 1 illustrates a perspective view of a section of a plate-fin heat exchanger.

FIG. 1 illustrates a perspective view of a section of a plate-fin heat exchanger 100. Specifically, this figure shows the various components of the heat exchanger 100, which may include a cold fluid pathway 110, a hot fluid pathway 120, cold bars 130, cold fins 140, hot bars 150, hot fins 160, side plate 170, and/or tube sheets 180. In addition, FIG. 1 shows the hot-cold corner 190 and the hot-hot corner 195 of the heat exchanger 100. Such a heat exchanger may further include a second side plate (omitted for clarity) at the opposite side of the heat exchanger 100 from the first side plate 170.

Figure 2:
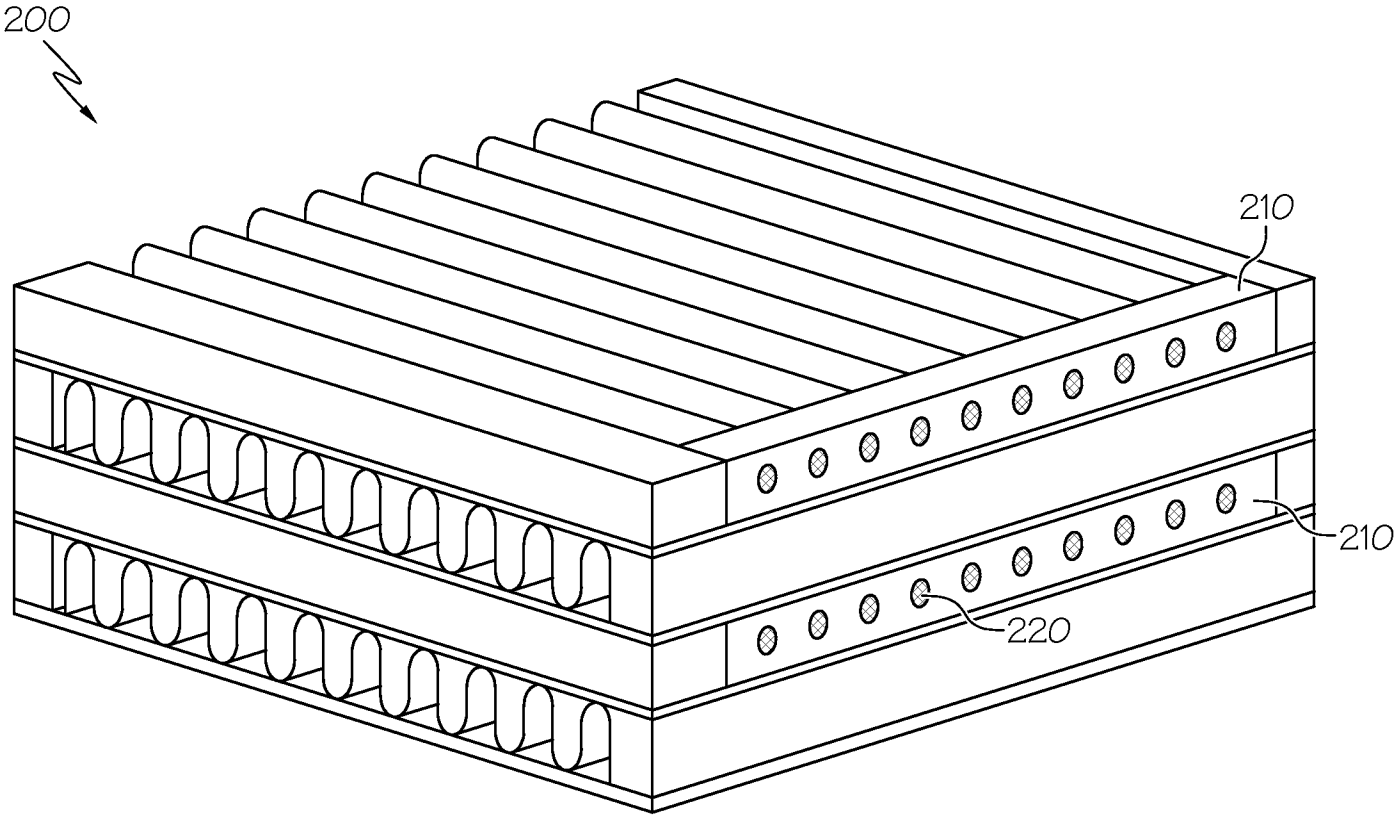
FIG. 2 illustrates a perspective view of a section of a plate-fin heat exchanger including a porous blocker bar according to an exemplary embodiment of the present invention.

FIG. 2 illustrates a perspective view of a section of a plate-fin heat exchanger 200 including porous blocker bars 210 according to an exemplary embodiment of the present invention. The blocker bars may be placed at each inlet and/or outlet to each flow passageway.

Such porous blocker bars may provide improved structural integrity, reinforcing the tube sheets 180 and more evenly distributing loads across the passage width of the hot inlet face. In addition, the blocker bars may reduce global and local temperature gradients within the passages of the heat exchanger by increasing local capacitance, thus slowing down metal temperature reaction rates in critical areas. The temperature gradients may also be improved by restricting the amount of hot fluid flow that can enter the passages.

As shown in FIG. 2, each porous blocker bar 210 may include multiple "pores" 220 (i.e., enclosed passageways or openings that may allow fluid to flow through the porous blocker bar). The pores 220 may be round through-holes oriented along one axis of the blocker bar 210. In some embodiments, the heat exchanger 200 may be sealed and connected in such a way that the operating parameters of the hot fluid pathway 120 may be determined by the pores 220. In this manner, the pores may be used to control hot flow through the heat exchanger (e.g., by configuring the pores to have an appropriate size and/or spacing for the desired flow). The porous blocker bars 210 and/or the pores 220 may utilize application-specific configurations, as described in more detail below.

The cold fluid pathway 110 may allow cold fluid to pass through the heat exchanger 200 in a first direction (indicated by arrow 110). The cold bars 130 may be arranged such that the bars seal the edges of the cold fluid pathway 110 along the direction of flow. The cold fins 140 may be arranged such that the fins allow fluid to flow along the cold fluid pathway 110. The hot fluid pathway 120 may allow hot fluid to pass through the heat exchanger in a second direction (indicated by arrow 120). The hot bars 150 may be arranged such that the bars seal the edges of the hot fluid pathway 120 along the direction of flow. The hot fins 160 may be arranged such that the fins allow fluid to flow along the hot fluid pathway 120. The side plate (or plates) 170 and tube sheets 180 may be arranged such that the pathways 110-120 each allow flow along a single axis. Each fluid pathway may include a number of flow passages (i.e., flow paths at each level of the pathway).

Although the pores 220 are represented as round through-holes in the example of FIG. 2, one of ordinary skill in the art will recognize that different embodiments may include different pores, as appropriate. For example, some embodiments may include pores that have non-round shapes (e.g., square, triangular, octagonal, etc.) or are otherwise irregularly-shaped (e.g., ellipses, non-symmetrical polygons, etc.). In addition, some embodiments may include different pores (e.g., a single embodiment may include round and non-round pores). Furthermore, some embodiments may include non-uniformly sized pores (e.g., the pores may be sized to be smaller at the ends of the blocker bar and larger near the center of the blocker bar, or vice-versa).

The various components of the heat exchanger 200 may be made from various appropriate materials (e.g., steel, aluminum, titanium, etc.) and/or combinations of materials. In addition, the heat exchanger may include different numbers of various components, as appropriate (e.g., based on the size of the heat exchanger, operating temperatures, flow requirements, etc.). Such components may be arranged in various appropriate ways. For example, different embodiments may include different numbers of flow passages. As another example, different embodiments may include different numbers of hot and/or cold bars (and interceding hot and/or cold fins) at each passage.

Figure 3:
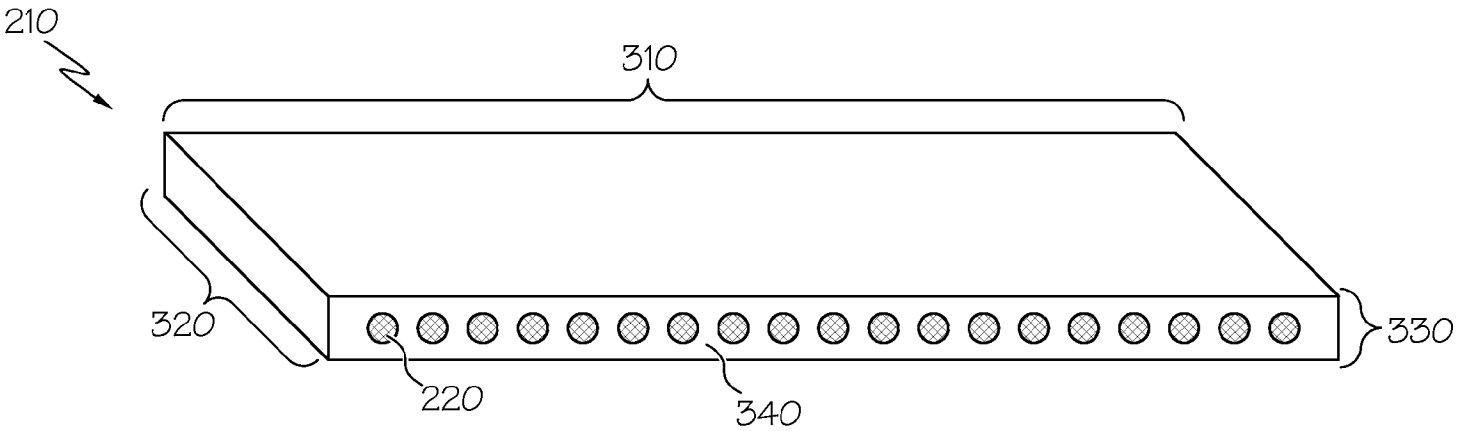
FIG. 3 illustrates a detailed perspective view of the porous blocker bar of FIG. 2.

FIG. 3 illustrates a perspective view of the porous blocker bar 210. As shown, in some embodiments, the blocker bar may have a generally rectangular shape, where the shape may be defined by a width 310, depth 320, and height 330. Different embodiments may utilize different blocker bars, as appropriate (e.g., bars of varying size, shape, etc.). The pores 220 may run from a front face 340 of the blocker bar to a rear face. The front face may be situated to face toward the direction of the hot fluid pathway 120 (i.e., the inlet end of the pathway) while the rear face may be situated to face toward the outlet end of the pathway. In this example, the pores are arranged at constant spacing along the middle of the front face 340, however, the pores may be arranged in various appropriate ways (e.g., a grid of offset pores, sets of pores at various locations along the face, etc.).

Figure 4:
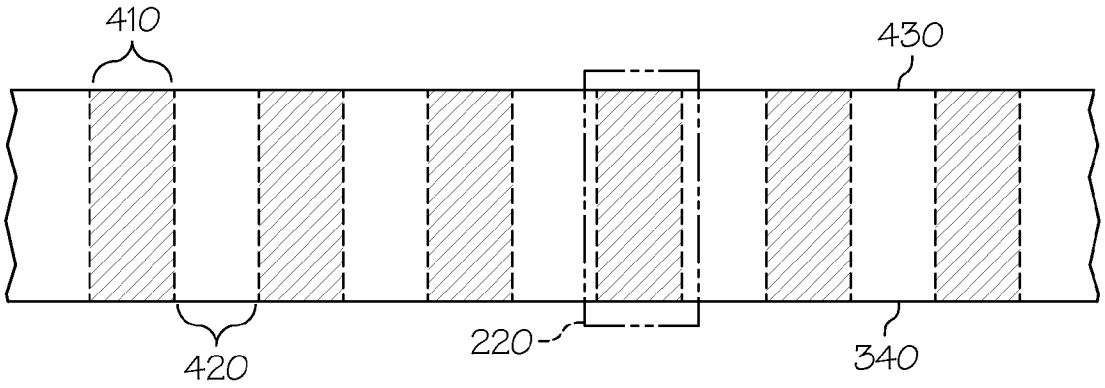
FIG. 4 illustrates a top view of a section of the porous blocker bar of FIG. 2, specifically highlighting the size and spacing of pores along the porous blocker bar.

FIG. 4 illustrates a top view of a section of the porous blocker bar 210, specifically highlighting the size 410 and spacing 420 of pores 220 along the porous blocker bar. In this example, the pores run from the front face 340 to the rear face 430. The size 410 of the pores 220 is defined by a diameter of the through-hole, while the spacing 420 is defined by a distance along a second axis of the blocker bar. Although the pores 220 are shown in this example as having a constant diameter through the entire depth 320 of the blocker bar 210, different embodiments may have differently-shaped pores (e.g., the pores may taper from a larger diameter at the inlet side of the blocker bar to a smaller diameter at the outlet side of the blocker bar, or vice-versa).

Figure 5:
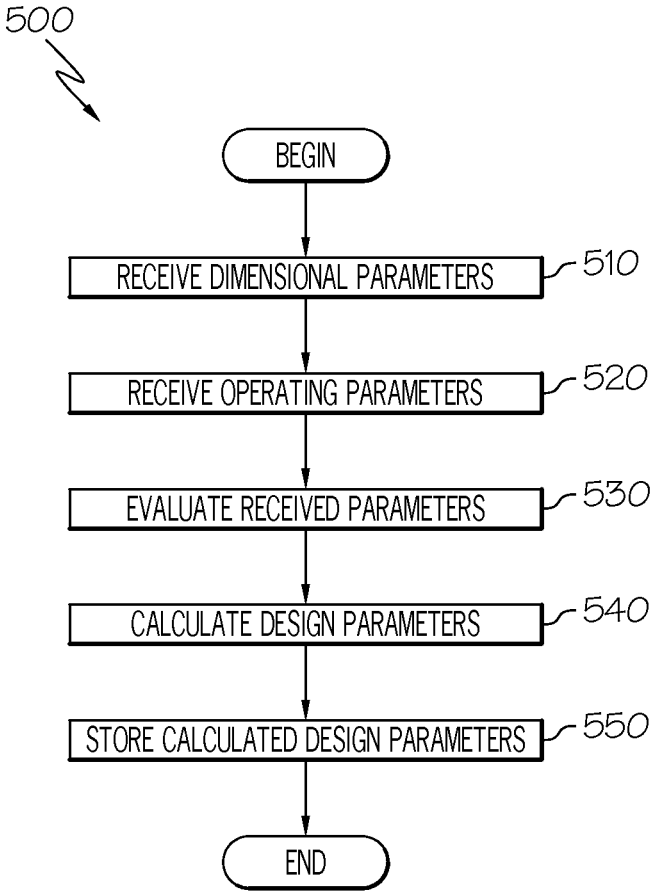
FIG. 5 illustrates a flow chart of a conceptual process used in some embodiments to configure various physical parameters of the porous blocker bar of FIG. 2.

FIG. 5 illustrates a flow chart of a conceptual process 500 used in some embodiments to configure various physical parameters of the porous blocker bar 210. Such application-specific configurations may allow the porous blocker bars to be optimized for use in a variety of heat exchangers that may correspond to a variety of applications. The process may be performed by a system such as the system 600 described below.

Process 500 may begin when a user begins design of a porous blocker bar. As shown, the process may receive (at 510) dimensional parameters. Such dimensional parameters may include the size and/or shape of the blocker bar, desired pore size, etc. Next, the process may receive (at 520) various operating parameters for the blocker bar. Such operating parameters may include minimum and/or maximum flow rates, operating temperatures, etc. In addition, the operating parameters may include various user-desired performance of the heat exchanger (e.g., temperature gradients, heat exchange, operating life, etc.).

The process may then evaluate (at 530) the parameters received at 510 and 520. Such evaluation may include comparing the received parameters to various thresholds or tolerances, any limitations of the manufacturing facility, etc. The process may then calculate (at 540) various design parameters. Such calculation may involve performing a set of mathematical operations, optimizing results for a particular manufacturing facility, etc. The design parameters may include the size, shape, and/or spacing of pores to be included in the blocker bar. Finally, the process may store (at 550) the calculated design parameters and then end. The stored design parameters may then be available for use in designing and manufacturing the blocker bars.

Although process 500 has been described with reference to various details, one of ordinary skill in the art will recognize that the process may be performed in various appropriate ways without departing from the spirit of the invention. For instance, the operations of the process may be performed in various different orders. As another example, only a subset of operations may be performed in some embodiments, or the process may be performed as a set of sub-processes. As yet another example, the process may be performed as a sub-process of another process.

Figure 6:
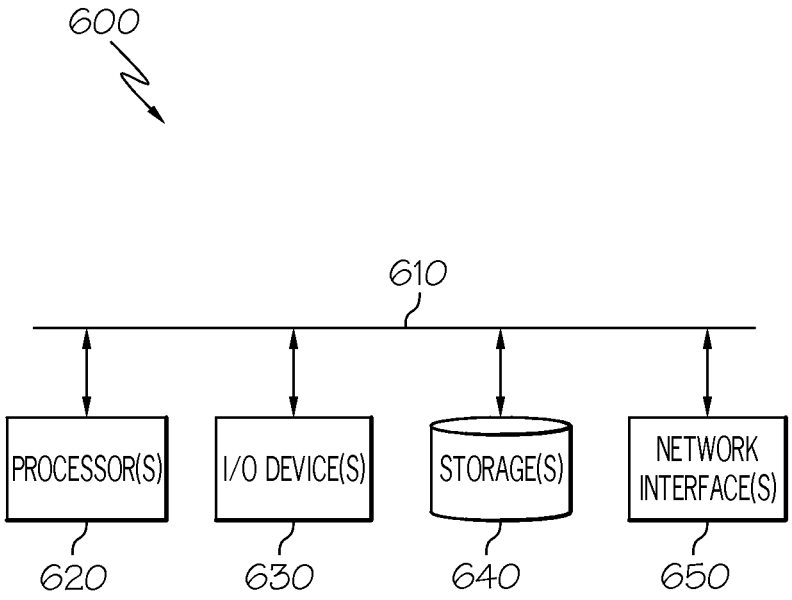
FIG. 6 illustrates a schematic diagram of a conceptual system used in some embodiments to implement the process of FIG. 5.

FIG. 6 illustrates a schematic diagram of a conceptual system 600 used in some embodiments to implement process 500. As shown, the system 600 may include a bus 610, one or more processors 620, one or more input/output devices 630, one or more storages 640, and/or one or more network interface(s). The system may be implemented using a variety of specific devices, either alone or in conjunction (e.g., a mobile device, a personal computer, a tablet device, a Smartphone, a server, etc.) and/or a variety of communication pathways, either alone or in conjunction (e.g., physical pathways such as wires and cables, wireless pathways, etc.).

The bus 610 conceptually represents all communication pathways available to the system 600. The processor(s) 620 may include various computing devices (e.g., microprocessors, digital signal processors, application-specific integrated circuits, etc.). The input/output device(s) 630 may include input devices such as mice, keyboards, etc., and/or output devices such as monitors, printers, etc. The storage(s) 640 may include various transitory and/or non-transitory storage(s) (e.g., RAM storage, ROM storage, "cloud" storage, etc.). The network interface(s) 650 may include various circuitry and/or software that allow the system 600 to connect to one or more networks (e.g., a local-area network, a wide-area network, etc.) or one or more networks of networks (e.g., the Internet).

System 600 may be used to execute the operations of, for instance, process 500. In some embodiments, process 500 may be implemented using sets of software instructions. Such sets of software instructions may be stored in storage 640 such that they may be retrieved and executed by processor 620. In addition, data such as dimensional parameters and/or operating parameters may be stored in storage 640. Processor 620 may retrieve and use the data when executing the software instructions to evaluate the received parameters and calculate the design parameters. The processor 620 may send the calculated design parameters to the storage 640. In this manner, the calculated design parameters may be made available to various appropriate manufacturing entities (e.g., the design parameters may be used to generate technical drawings that are supplied to a machine shop that will fabricate the porous blocker bars).

It should be understood, of course, that the foregoing relates to exemplary embodiments of the invention and that modifications may be made without departing from the spirit and scope of the invention as set forth in the following claims.

We claim:

1. A plate-fin heat exchanger, comprising:

a heat exchanger face;

a first fluid pathway running along a first axis the first fluid pathway including a first plurality of passages, each of the first plurality of passages including both a plurality of first bars running parallel to the first axis and at least one first fin oriented to allow fluid to flow along the first axis;

a second fluid pathway running along a second axis perpendicular to the first axis; and a blocker bar having an inlet face and an outlet face;

wherein the blocker bar inlet face coincides with the heat exchanger face;

wherein the blocker bar is at an inlet of the second fluid pathway and receives a second fluid;

wherein the outlet face of the blocker bar is at the inlet of the second fluid pathway;

wherein the blocker bar includes a set of spaced apart pores that extend from the inlet face to the outlet face.

2. The plate-fin heat exchanger of claim 1, the second fluid pathway including a second plurality of passages, each of the second plurality of passages including:

a plurality of second bars running parallel to the second axis; and at least one second fin oriented to allow fluid to flow along the second axis.

3. The plate-fin heat exchanger of claim 2, wherein the blocker bar is coupled to at least two of the second bars.

4. The plate-fin heat exchanger of claim 1, wherein each pore of the set of pores is cylindrically-shaped.

5. The plate-fin heat exchanger of claim 1, wherein the set of pores is oriented to allow flow along the second axis.

6. A plate-fin heat exchanger, comprising:

a heat exchanger face;

a first passageway;

a second passageway in a cross flow orientation to the first passageway;

a pair of non-porous sealing bars;

wherein a respective sealing bar is disposed along and at each of two respective opposing edges of the second passageway;

a porous blocker bar having a plurality of pores and an inlet face that coincides with the heat exchanger face;

wherein the porous blocker bar is at an inlet of the second passageway;

wherein the plurality of pores of the blocker bar pass fluid into the second passageway;

wherein the blocker bar is between the sealing bars and in contact with the ends of the sealing bars.

7. The porous blocker bar of claim 6, wherein each of said the plurality of pores has a cylindrical shape.

8. The porous blocker bar of claim 6, wherein the plurality of pores are substantially evenly spaced across a front face of the porous blocker bar.

9. The porous blocker bar of claim 6, wherein each pore has a uniform diameter.

10. The porous blocker bar of claim 6, wherein the height of the porous blocker bar is configured to match the height of each sealing bar and a width of a fin of the plate-fin heat exchanger.

11. The porous blocker bar of claim 6, wherein each pore is parallel to an axis of flow through the heat exchanger.

* * * * *